US006508178B2

(12) United States Patent
Shelton

(10) Patent No.: US 6,508,178 B2
(45) Date of Patent: Jan. 21, 2003

(54) AERIAL FIREWORKS PRODUCT HAVING SYNTHETIC RESINOUS STABILIZING BASE

(76) Inventor: Gregory P. Shelton, 24073 24th St., Eagleville, MO (US) 64442

( * ) Notice: Subject to any disclaimer, the term of this patent is extended or adjusted under 35 U.S.C. 154(b) by 3 days.

(21) Appl. No.: 09/751,853

(22) Filed: Dec. 29, 2000

(65) Prior Publication Data

US 2002/0083861 A1 Jul. 4, 2002

(51) Int. Cl.[7] ..... F42B 4/06; F41F 3/04; B64F 1/04

(52) U.S. Cl. ..... 102/349; 102/347; 102/360; 102/361; 89/1.8; 89/1.806; 244/63

(58) Field of Search ..... 89/1.8, 1.806, 89/1.816; 102/349, 347, 351, 357, 360, 361; 244/63

(56) References Cited

U.S. PATENT DOCUMENTS

| | | | | | |
|---|---|---|---|---|---|
| 41,689 | A | * | 2/1864 | Edge | |
| 72,030 | A | | 12/1867 | Hadfield | |
| 133,234 | A | | 11/1872 | Licht | |
| 148,553 | A | | 3/1874 | Detwiller | |
| 276,007 | A | | 4/1883 | Detwiller | |
| 303,839 | A | * | 8/1884 | Hadfield | 102/349 |
| 310,598 | A | | 1/1885 | Linton | |
| 753,151 | A | * | 2/1904 | Lloyd | 102/349 |
| 2,307,125 | A | * | 1/1943 | Goddard | 244/63 |
| 3,029,704 | A | * | 4/1962 | Truax | 89/1.806 |
| 3,068,792 | A | * | 12/1962 | Brown et al. | 102/349 |
| 3,903,801 | A | * | 9/1975 | Senoski | |
| 4,771,695 | A | | 9/1988 | Simpson | |
| 4,917,015 | A | | 4/1990 | Lowery | |
| 5,339,741 | A | * | 8/1994 | Craven et al. | 102/361 |
| 5,567,907 | A | | 10/1996 | Westfall | |
| 5,750,915 | A | * | 5/1998 | Bedegrew et al. | 89/1.8 |
| 5,974,939 | A | * | 11/1999 | Deel | 89/1.8 |
| 5,979,329 | A | * | 11/1999 | Collar | 102/349 |
| 6,055,910 | A | * | 5/2000 | Zanakis et al. | 102/347 |
| 6,283,033 | B1 | * | 9/2001 | Wu et al. | 102/360 |
| 6,286,429 | B1 | * | 9/2001 | Marietta et al. | 102/351 |
| 6,321,631 | B1 | * | 11/2001 | Deel | 89/1.8 |
| 6,386,112 | B1 | * | 5/2002 | Shelton | |

* cited by examiner

*Primary Examiner*—Michael J. Carone
*Assistant Examiner*—Lulit Semunegus
(74) *Attorney, Agent, or Firm*—Hovey Williams LLP

(57) ABSTRACT

The product includes a self-propelled aerial pyrotechnic device and an upright launch tube for the device. The device is closely confined within the launch tube so as to be maintained in an essentially truly vertical orientation in preparation for launch. The device itself comprises a body containing pyrotechnic display material and an engine that serves to propel the body when ignited. A stabilizing base, preferably integrally molded from synthetic resinous material, is attached to the lower end of the body and is in the nature of a framework having a plurality of symmetrically disposed, long legs interconnected at various locations by strut structure. The engine is received within a socket at the upper end of the stabilizing base and is adhered to interior surfaces of the legs to provide a secure connection between the body and the base.

28 Claims, 2 Drawing Sheets

10
12
14
16
18
20
22
24
26
28
30
32
34
36
38
40
41
42
43
44
46
48
50
52
54
56
58
60
62
64
66
68
70
72
74

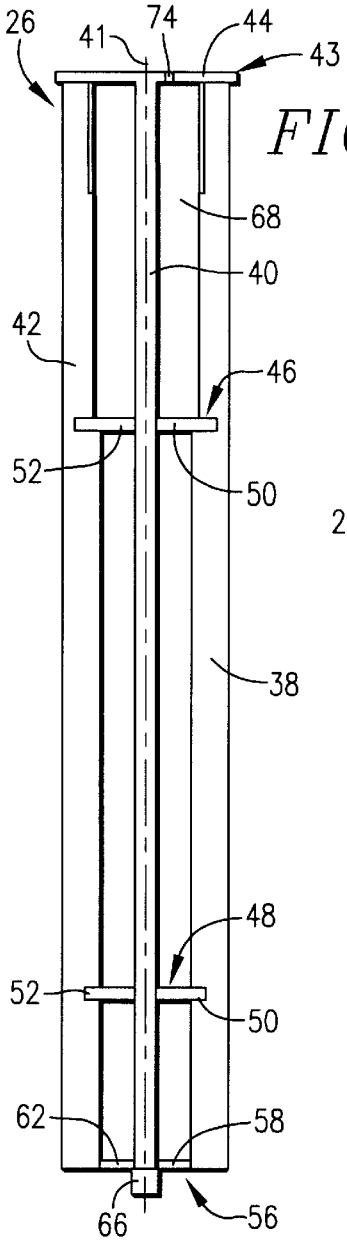
FIG. 4.
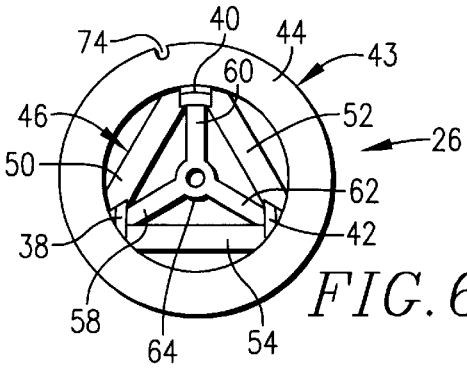
FIG. 6.
FIG. 3.
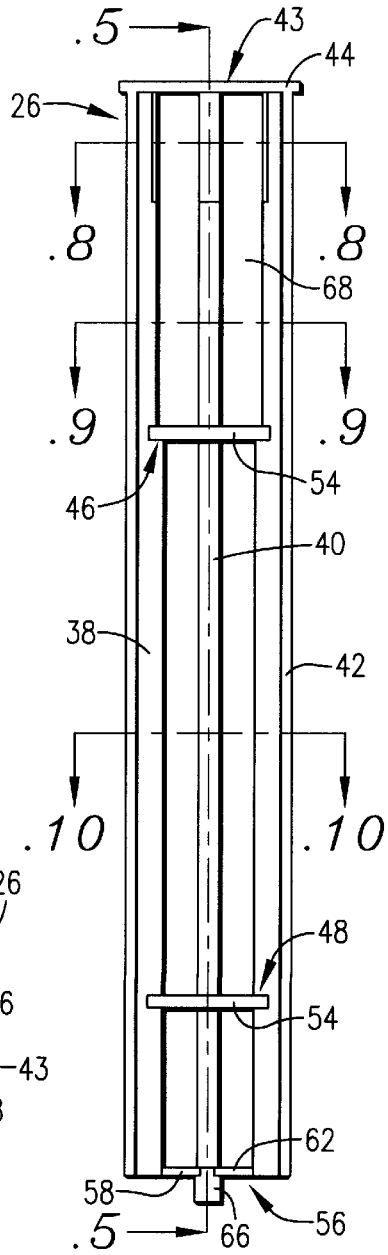
FIG. 5.
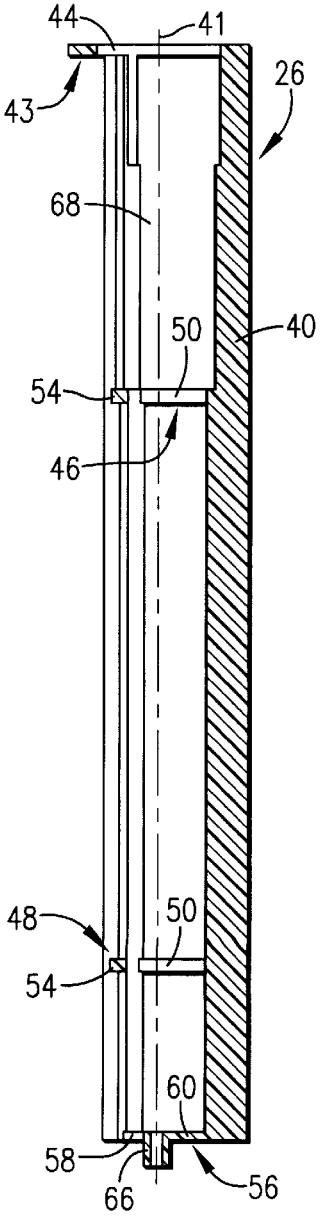
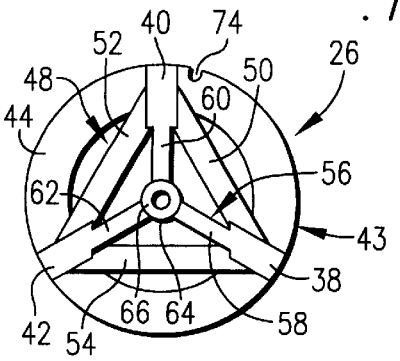
FIG. 7.

AERIAL FIREWORKS PRODUCT HAVING SYNTHETIC RESINOUS STABILIZING BASE

TECHNICAL FIELD

This invention relates generally to fireworks and, more particularly, to an aerial fireworks product comprising an upstanding launch tube and a self-propelled aerial device that is adapted to be inserted into and launched from the tube. More specifically, the invention relates to improvements in the stabilizing base that forms an important part of the aerial device.

BACKGROUND

My co-pending application Ser. No. 09/482,579 filed Jan. 13, 2000 now U.S. Pat. No. 6,586,112B6 titled "Aerial Fireworks Product" discloses a self-propelled aerial device launched from within an upright launching tube. The body of the device includes a packet of incendiary materials that produce a pyrotechnic display when ignited during flight, as well as an engine for propelling the device skyward. Three wooden legs project down from the body to serve as a means of stabilizing the device during flight, and also as a means of standing the device upright within the launch tube prior to ignition.

The stabilizer is a critical component of the device. For example, if all parts of the stabilizer are not substantially symmetrical with the center line of symmetry of the body and engine, the device may fly in an errant or unpredictable manner, rather than straight up vertically as intended. Achieving such a high level of symmetry with wooden sticks or legs as the stabilizing means is problematic because, for one thing, the sticks tend to warp out of a perfectly straight configuration over time, thus displacing their center of gravity off to one side. Moreover, some portions of the wooden stick tend to retain different amounts of moisture than other portions, causing weight distribution problems between the multiplicity of sticks.

SUMMARY OF THE INVENTION

Accordingly, an important object of the present invention is to provide an improved stabilizing base for a self-propelled aerial pyrotechnic device that addresses problems associated with my previous stabilizing means. In this respect, the present invention provides a stabilizer in the nature of a framework having a plurality of longitudinally extending legs spaced about the axis of symmetry of the device and transverse strut structure that interconnects the legs in a manner to retain them against significant displacement out of a symmetrical relationship. In a preferred form of the invention, three legs are provided so as to form corners of a triangle when the framework is viewed in transverse cross section, thus providing a sturdy, essentially rigid framework. In a further form of the invention, the framework is constructed of integrally molded synthetic resinous material to facilitate manufacture and to eliminate the problems with moisture retention in my earlier stabilizing legs.

The framework presents an elongated, open socket at its upper end into which the engine of the body is inserted during manufacture of the device. Preferably, a suitable adhesive between the engine and interior surfaces of the legs of the framework is used to bond the body of the device to the framework. The strut structure of the framework includes not only an annular ring that covers and interconnects the upper ends of the legs, but also a pair of generally triangular in plan strut units at two locations below the ring. The upper strut unit serves also as a limit stop for engaging the bottom extremity of the engine during assembly of the product at the factory, thereby establishing the maximum extent to which the engine can be inserted into the socket of the framework. A nib-like projection or button extending from the bottom of the framework keeps the framework from being self-supporting if attempts are made to stand the device upright outside of the launch tube, causing the device to tip over.

BRIEF DESCRIPTION OF THE DRAWINGS

FIG. 3 is an elevational view of the stabilizing base;

FIG. 4 is an opposite side elevational view of the base;

FIG. 5 is a longitudinal cross sectional view of the base taken substantially along line 5—5 of FIG. 3;

FIG. 6 is a top end elevational view of the stabilizing base;

FIG. 7 is a bottom end elevational view of the stabilizing base;

DETAILED DESCRIPTION

Figures 1, 2, 8, 9, 10:
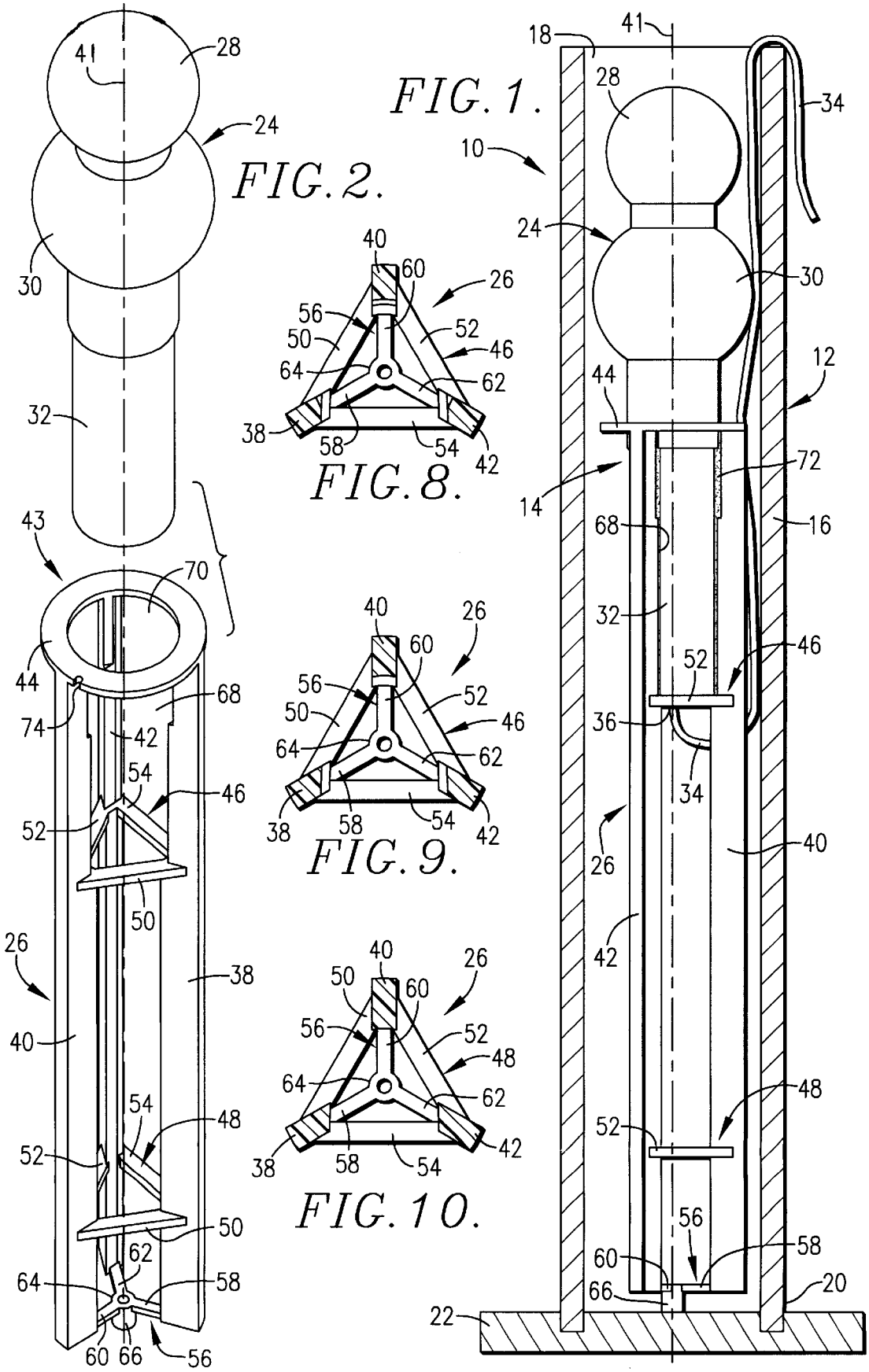
FIG. 1 is a vertical cross sectional view of a launch tube and aerial device in accordance with the present invention showing the device fully received within the tube preparatory to launching.
FIG. 2 is an exploded isometric view of the aerial device showing the body and stabilizing base as two separate parts prior to assembly.
FIG. 8 is a transverse cross sectional view through the base taken substantially along line 8—8 of FIG. 3.
FIG. 9 is a transverse cross sectional view through the base taken substantially along line 9—9 of FIG.3.
FIG. 10 is a transverse cross sectional view through the base taken substantially along line 10—10 of FIG. 3.

The aerial pyrotechnic product broadly denoted by the numeral 10 includes two primary components, i.e., a launcher 12 and a self-propelled aerial device 14 adapted for use with launcher 12. Launcher 12 includes an upright tube 16 having an open upper end 18 and a closed lower end 20. A base 22 is secured to lower end 20 and is adapted to rest on a supporting flat surface in such a manner that tube 16 is disposed in an upright, essentially vertical disposition. Base 22 closes off the lower end of tube 16 and effectively defines a floor of the tube. In the disclosed embodiment, the tube 16 is preferably constructed of a plastic material but may be constructed from other acceptable materials such as, for example, paste board as well understood by those skilled in the art.

Aerial device 14 includes a body 24 and a stabilizing base 26. Body 24 comprises an incendiary portion and an engine portion, the incendiary portion including a pair of stacked balls 28 and 30 that produce a pyrotechnic display when ignited, in the particular embodiment illustrated in the drawings. The engine portion comprises a generally cylindrical engine 32 projecting downwardly from the bottom ball 30. Engine 32 contains a charge of propellant that, when ignited, provides lift for device 14 so as to render it self-propelled in nature. A long fuse 34 (FIG. 1), having a length that exceeds the total length of the device, is secured at point 36 to the bottom of engine 32. It will be appreciated by those skilled in the art that body 24 may assume a variety of different configurations including, without limitation, a generally cylindrical overall shape and a conical nose cone.

Stabilizing base 26 comprises a framework having three equal length, substantially identical, longitudinally extending legs 38,40 and 42. Legs 38,40 and 42 are spaced around the axis of symmetry 41 of the device at equal 120° degree intervals and are all spaced the same radial distance outwardly from such axis of symmetry. Generally speaking, legs 38, 40 and 42 are rectangular in overall cross sectional configuration as maybe seen viewing FIGS. 8,9 and 10, although the innermost surfaces the legs may be provided with draft angles to facilitate manufacturing base 26 using an injection molding technique. The longitudinal axes of legs 38, 40 and 42 all extend parallel to the axis of symmetry 41.

The framework of base 26 further includes strut structure broadly denoted by the numeral 43 that interconnects legs 38,40 and 42 with one another to retain them in their symmetrically disposed positions. Such strut structure 43 includes a ring 44 that covers and interconnects the uppermost ends of legs 38, 40 and 42. Additionally, strut structure 43 includes at least a pair of generally triangular strut units 46 and 48 spaced below ring 44 along the length of the legs. Strut units 46 and 48 are identical to one another, each having three horizontal struts 50, 52, and 54 that lie in a common horizontal plane and fixedly interconnect legs 38, 40 and 42.

Strut structure 43 also includes a lowermost spider 56 comprising three horizontal spokes 58, 60 and 62 that diverge from a central hub 64 to join with respective legs 38, 40 and 42. A tip-over projection or button 66 projects down from hub 64 beyond and below the legs 38, 40 and 42 to prevent stabilizing base 26 from being self-supporting in the event a user attempts to stand the base on a lower supporting surface outside of launch tube 16. In the preferred embodiment, stabilizing base 26 is integrally molded from a synthetic resinous material such as polyvinyl chloride.

At the upper end of stabilizing base 26, an elongated receiving socket 68 is defined by the proximal interior surfaces of legs 38, 40 and 42, as well as by a hole 70 in ring 44. Socket 68 receives engine 32 of body 24 as illustrated in FIG. 1, the upper strut unit 46 serving as a stop to limit the extent of insertion of engine 32. A layer of adhesive 72 along the length of engine 32 bonds the latter to legs 38, 40 and 42. The upper end of socket 68 may be slightly enlarged relative to the lower region thereof so as to accommodate engines 32 that may have upper portions of a larger diameter than lower portions. Preferably, the stop provided by upper strut unit 46 and the length of engine 32 are such that engine 32 is not fully received within socket 68 but instead projects a short distance upwardly therebeyond as illustrated in FIG. 1.

When the aerial device 14 is inserted into launch tube 16 with body 24 disposed upwardly, the tip-over button 66 engages base 22. However, the interior diameter of launch tube 16 is preferably only slightly greater than the maximum cross sectional width of aerial device 14 such that device 14 is retained by tube 16 in an essentially vertical orientation. Preferably, the internal diameter of the tube 16 exceeds the maximum transverse cross sectional width of the device 14 by an amount that is approximately double the thickness of fuse 34. This provides ample clearance for fuse 36 when device 14 is within tube 16 and fuse 34 is directed up along side device 14 and up over the upper edge of launch tube 16. A notch 74 in the outer periphery of ring 44 helps retain and locate fuse 34.

In the preferred embodiment launch tube 16 is somewhat taller than the overall length of aerial device 14 such that device 14 is completely received within tube 16 prior to launch and during ignition of fuse 34. Although tube maybe somewhat shorter than illustrated, it should be at least as tall as necessary to partially surround the upper ball 28 of body 24.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby state(s) his intent to rely on the Doctrine of Equivalents to determine and assess the reasonably fair scope of his invention as pertains to any apparatus not materially departing from but outside the literal scope of the invention as set out in the following claims.

What is claimed is:

1. A self-propelled aerial pyrotechnic device comprising:

a body at the upper end of the device including a collection of ignitable incendiary display materials and an engine containing a charge for propelling the device when the charge is ignited; and a base at the lower end of the device and permanently secured to the body for travel therewith to stablize the device during flight, said device having a longitudinal axis of symmetry, said base comprising a framework including a plurality of longitudinally extending, laterally spaced, substantially similar legs disposed symmetrically about said axis of symmetry and strut structure interconnecting said legs and disposed symmetrically about said axis of symmetry.

2. A self-propelled aerial pyrotechnic device as claimed in claim 1, said base being constructed from synthetic resinous material.

3. A self-propelled aerial pyrotechnic device as claimed in claim 1, said strut structure including a strut between each pair of said legs.

4. A self-propelled aerial pyrotechnic device as claimed in claim 1, said strut structure comprising at least a pair of strut units spaced along the length of the base, each of said strut units comprising a plurality of struts interconnecting respective pairs of said legs.

5. A self-propelled aerial pyrotechnic device as claimed in claim 4, there being a total of three of said legs, each of said strut units being generally triangular in plan.

6. A self-propelled aerial pyrotechnic device as claimed in claim 1, said legs cooperating to define therebetween a longitudinally extending receiving socket adjacent the upper end of the base, said engine of the device being received within said socket.

7. A self-propelled aerial pyrotechnic device comprising:

a body at the upper end of the device including a collection of ignitable incendiary display materials and an engine containing a charge for propelling the device when the charge is ignited; and a base at the lower end of the device and secured to the body for stabilizing the device during flight, said device having a longitudinal axis of symmetry, said base comprising a framework including a plurality of longitudinally extending, laterally spaced, substantially similar legs disposed symmetrically about said axis of symmetry and strut structure interconnecting said legs and disposed symmetrically about said axis of symmetry, said legs cooperating to define therebetween a longitudinally extending receiving socket adjacent the upper end of the base, said engine of the device being received within said socket, said engine being bonded to the legs.

8. A self-propelled aerial pyrotechnic device as claimed in claim 6, said base including means defining a stop that engages said engine to limit the extent of insertion thereof into said socket.

9. A self-propelled aerial pyrotechnic device comprising:

a body at the upper end of the device including a collection of ignitable incendiary display materials and an engine containing a charge for propelling the device when the charge is ignited; and a base at the lower end of the device and secured to the body for stabilizing the device during flight, said device having a longitudinal axis of symmetry, said base comprising a framework including a plurality of longitudinally extending, laterally spaced, substantially similar legs disposed symmetrically about said axis of symmetry and strut structure interconnecting said legs and disposed symmetrically about said axis of symmetry, said legs cooperating to define therebetween a longitudinally extending receiving socket adjacent the upper end of the base, said engine of the device being received within said socket, said base including means defining a stop that engages said engine to limit the extent of insertion thereof into said socket, said strut structure including a portion of said strut structure positioned to serve as said stop.

10. A self-propelled aerial pyrotechnic device as claimed in claim 9, said strut structure including a generally triangular strut unit including a plurality of struts interconnecting respective pairs of the legs, said portion of the strut structure comprising said strut unit.

11. A self-propelled aerial pyrotechnic device as claimed in claim 1, said legs having upper ends, said strut structure including a ring interconnecting and covering said upper ends of the legs.

12. A self-propelled aerial pyrotechnic device comprising:

a body at the upper end of the device including a collection of ignitable incendiary display materials and an engine containing a charge for propelling the device when the charge is ignited; and a base at the lower end of the device and secured to the body for stabilizing the device during flight, said device having a longitudinal axis of symmetry, said base comprising a framework including a plurality of longitudinally extending, laterally spaced, substantially similar legs disposed symmetrically about said axis of symmetry and strut structure interconnecting said legs and disposed symmetrically about said axis of symmetry, said legs having upper ends, said strut structure including a ring interconnecting and covering said upper ends of the legs, said ring having a central hole, said legs cooperating to define therebetween a longitudinally extending receiving socket below and axially aligned with said ring, said engine of the device being received within said hole and said socket.

13. A self-propelled aerial pyrotechnic device as claimed in claim 1, said base having a lowermost projection extending downwardly from and beyond said framework for preventing the device from being self-supporting in an upright condition on a supporting surface.

14. A self-propelled aerial pyrotechnic device comprising:

a body at the upper end of the device including a collection of ignitable incendiary display materials and an engine containing a charge for propelling the device when the charge is ignited; and a base at the lower end of the device and secured to the body for stabilizing the device during flight, said device having a longitudinal axis of symmetry, said base comprising a framework including a plurality of longitudinally extending, laterally spaced, substantially similar legs disposed symmetrically about said axis of symmetry and strut structure interconnecting said legs and disposed symmetrically about said axis of symmetry, said base being integrally molded from a synthetic resinous material.

15. An aerial fireworks product comprising:

a launcher including a tube and a base secured to said tube for supporting the tube in an upright condition on a supporting surface, said tube having upper and lower ends and a continuous, annular sidewall extending between said ends to define an elongated, internal launching chamber within the tube, said upper end of the tube being open; and a self-propelled aerial pyrotechnic device adapted for launching from said launcher, said device including, a body at an upper end of the device including ignitable incendiary display materials and an engine containing a charge for propelling the device when the charge is ignited, a base secured to the body and projecting therefrom at a lower end of the device for supporting the body above the lower end of the tube when the device is placed in the launch chamber with the upper end of the device up and the lower end of the device down, and for stabilizing the device during flight after launching from the tube, said base comprising a framework including a plurality of longitudinally extending, laterally spaced, substantially similar legs and strut structure interconnecting said legs, and a fuse secured to and leading from said engine, said tube having an internal diameter that exceeds the maximum transverse cross-sectional width of the device and a height that causes at least a portion of the body of the device to be surrounded by the wall of the tube when the device is contained within the launch chamber and to present a generally annular space between the body and the sidewall, said fuse having a length that exceeds the distance between its point of securement to the engine and the open upper end of the tube when the device is contained within the launch chamber whereby to cause the fuse to extend through said annular space and out the open upper end of the tube when the device is loaded into and contained within the tube in preparation for launching.

16. An aerial fireworks product as claimed in claim 15, said base being constructed from synthetic resinous material.

17. An aerial fireworks product as claimed in claim 15, said strut structure including a strut between each pair of said legs.

18. An aerial fireworks product as claimed in claim 15, said strut structure comprising at least a pair of strut units spaced along the length of the base, each of said strut units comprising a plurality of struts interconnecting respective pairs of said legs.

19. An aerial fireworks product as claimed in claim 18, there being a total of three of said legs, each of said strut units being generally triangular in plan.

20. An aerial fireworks product as claimed in claim 15, said legs cooperating to define therebetween a longitudinally extending receiving socket adjacent the upper end of the base, said engine of the device being received within said socket.

21. An aerial fireworks product as claimed in claim 20, said engine being bonded to the legs.

22. An aerial fireworks product as claimed in claim 20, said base including means defining a stop that engages said engine to limit the extent of insertion thereof into said socket.

23. An aerial fireworks product as claimed in claim 22, said strut structure including a portion of said strut structure positioned to serve as said stop.

24. An aerial fireworks product as claimed in claim 23, said strut structure including a generally triangular strut unit including a plurality of struts interconnecting respective pairs of the legs, said portion of the strut structure comprising said strut unit.

25. An aerial fireworks product as claimed in claim 15, said legs having upper ends, said strut structure including a ring interconnecting and covering said upper ends of the legs.

26. An aerial fireworks product as claimed in claim 25, said ring having a central hole, said legs cooperating to define therebetween a longitudinally extending receiving socket below and axially aligned with said ring, said engine of the device being received within said hole and said socket.

27. An aerial fireworks product as claimed in claim 15, said base having a lowermost projection extending downwardly from and beyond said framework for preventing the device from being self-supporting in an upright condition on a supporting surface.

28. An aerial fireworks product as claimed in claim 15, said base being integrally molded from a synthetic resinous material.

* * * * *